US008729439B2

(12) United States Patent
Kim

(10) Patent No.: US 8,729,439 B2
(45) Date of Patent: May 20, 2014

(54) MICROWAVE OVEN WITH DOOR CHANGE DEVICE

(75) Inventor: Gong Soo Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 720 days.

(21) Appl. No.: 12/461,958

(22) Filed: Aug. 28, 2009

(65) Prior Publication Data

US 2010/0140261 A1 Jun. 10, 2010

(30) Foreign Application Priority Data

Dec. 5, 2008 (KR) ..... 10-2008-0123184

(51) Int. Cl.
*H05B 6/76* (2006.01)

(52) U.S. Cl.
USPC ..... 219/740; 219/715

(58) Field of Classification Search
USPC ..... 16/231–233; 49/381; 219/740, 715
See application file for complete search history.

(56) References Cited

U.S. PATENT DOCUMENTS

| | | | | | |
|---|---|---|---|---|---|
| 3,863,045 | A * | 1/1975 | Rosenberry | 219/722 |
| 3,889,419 | A * | 6/1975 | Maleck | 49/193 |
| 4,053,731 | A * | 10/1977 | Foerstner | 219/742 |
| 4,495,673 | A * | 1/1985 | Khan | 16/232 |
| 4,503,582 | A * | 3/1985 | Gurubatham | 16/232 |
| 4,947,583 | A * | 8/1990 | Inui et al. | 49/193 |
| 5,064,255 | A * | 11/1991 | Inui et al. | 312/405 |
| 5,187,836 | A * | 2/1993 | Kim et al. | 16/231 |
| 5,222,792 | A * | 6/1993 | Kai et al. | 312/406 |
| 5,548,927 | A * | 8/1996 | Song | 49/193 |
| 5,675,934 | A * | 10/1997 | Park | 49/193 |
| 5,829,197 | A * | 11/1998 | Oh | 49/193 |
| 6,000,771 | A * | 12/1999 | Wissinger et al. | 312/405 |
| 6,282,838 | B1 * | 9/2001 | Yoshikawa | 49/193 |
| 6,883,841 | B2 * | 4/2005 | Kawabata et al. | 292/336.3 |
| 2004/0040212 | A1 * | 3/2004 | Kawabata et al. | 49/193 |
| 2006/0289534 | A1 * | 12/2006 | Kim et al. | 219/761 |
| 2007/0256447 | A1 * | 11/2007 | Leimkuehler et al. | 62/440 |
| 2008/0172838 | A1 * | 7/2008 | Choi | 16/366 |

FOREIGN PATENT DOCUMENTS

| | | |
|---|---|---|
| KR | 1994-0001587 | 3/1994 |
| KR | 1995-0000871 | 2/1995 |
| KR | 10-1999-0034523 | 5/1999 |

* cited by examiner

*Primary Examiner* — A. Sefer
(74) *Attorney, Agent, or Firm* — Staas & Halsey LLP

(57) ABSTRACT

A microwave oven is capable of preventing a door that can be opened from a left side or a right side thereof from being simultaneously opened from both sides thereof. The microwave oven includes a body, a door, and a change device. The door is coupled with the body. The change device allows the door to be opened from both sides thereof. The change device includes a pair of holders, a pair of sliders, and at least one lever. The holders rotate as the door is opened from both sides thereof. The sliders linearly move in cooperation of the holders. The at least one lever restricts the linear movement of the sliders when the door is opened from one side thereof, thereby preventing the door from being open from a remaining side.

21 Claims, 12 Drawing Sheets

MICROWAVE OVEN WITH DOOR CHANGE DEVICE

CROSS-REFERENCE TO RELATED APPLICATIONS

This application claims the benefit of Korean Patent Application No. 10-2008-0123184, filed on Dec. 5, 2008, in the Korean Intellectual Property Office, the disclosure of which is incorporated herein by reference.

BACKGROUND

1. Field

The disclosure relates to a microwave oven. More particularly, the disclosure relates to a microwave oven capable of preventing a door that can be open from a left side or a right side thereof from being simultaneously open from both sides thereof.

2. Description of the Related Art

In general, a microwave oven irradiates a microwave generated from a magnetron to foods to cook the foods by using friction heat which is generated due to translation motion of water molecules contained in the foods.

Generally, the microwave oven includes a body having a cooking chamber and a door hinged to the body to open/close the cooking chamber. The door may be hinged to a left side of the body, so that a user can open the door using his/her left hand, called a left opening scheme. The door may be hinged to a right side of the body, so that the user can open the door using his/her right hand, called a right opening scheme. The user can select one of the two opening schemes to open the door.

However, the opening scheme of the door may have to be changed according to the installation place of the microwave oven. In other words, the door of the microwave oven employing the left opening scheme may be needed to be opened through the right opening scheme. In contrast, the door employing the right opening scheme may be needed to be opened through the left opening scheme according to the installation place of the microwave oven. In addition, in a microwave oven equipped with a door that can be opened from both sides thereof, when a user opens the door from one side of the door, the other side of the door has to be locked such that the door can be prevented from being separated from the body.

SUMMARY

Accordingly, it is an aspect of the disclosure to provide a microwave oven capable of preventing a door that can be opened from a left side or a right side from being simultaneously opened from both sides thereof.

Additional aspects and/or advantages will be set forth in part in the description which follows and, in part, will be apparent from the description, or may be learned by practice of the disclosure.

The foregoing and/or other aspects of the disclosure are achieved by providing a microwave oven including a body, a door coupled with the body, and a change device allowing the door to be opened from both sides thereof. The change device may include a pair of holders rotating as the door is opened from both sides thereof, a pair of sliders that linearly move in cooperation with the holders, and at least one lever restricting the linear movement of the sliders when the door is opened from one side thereof, thereby preventing the door from being open from a remaining side.

According to an aspect, the lever may include a locking part which is locked in a predetermined region of the sliders to fix the sliders.

According to an aspect, the sliders may include a receiving groove receiving the locking part.

According to an aspect, the lever may include a tension spring allowing the locking part to be inserted in the sliders.

According to an aspect, the receiving groove may have a locking region in which the locking part is locked by a pair of protrusion steps provided in the sliders.

According to an aspect, the locking region may include a left locking region, in which the locking part is locked when the door is opened from a left side, and a right locking region in which the locking part is locked when the door is opened from a right side.

According to an aspect, the protrusion steps make close contact with the locking part when the locking part is locked in the left locking region or the right locking region.

The foregoing and/or other aspects are achieved by providing a microwave oven including a body, a door coupled with the body, first and second shaft members provided in one of the body and the door, first and second insertion grooves provided in the other of the body and the door, first and second holders rotating in cooperation with the first and second shaft members as the first and second shaft members are introduced into/withdrawn from the first and second insertion grooves, and at least one lever fixing the first slider or the second slider when one of the first and second holders is separated from one of the first and second shaft members.

According to another aspect, the lever may include a first lever fixing the first and second sliders at a left side of the door and a second lever fixing the first and second sliders at a right side of the door.

According to another aspect, the first and second sliders may have a first receiving groove receiving the first lever and a second receiving groove receiving the second lever.

According to another aspect, the first and second levers may be coupled with a tension spring such that the first and second levers are inserted into the first and second receiving grooves.

According to another aspect, the first receiving groove may include a first upper receiving groove formed in the first slider and a first lower receiving groove formed in the second slider, and the second receiving groove may include a second upper receiving groove formed in the first slider, and a second lower receiving groove formed in the second slider.

According to another aspect, the first and second upper receiving grooves may have a left locking region in which the first and second levers are locked when the first holder is separated from the first shaft member, and the first and second lower receiving grooves may have a right locking region in which the first and second levers are locked when the second holder is separated from the second shaft member.

According to another aspect, the first and second receiving grooves may be provided therein with first and second protrusion steps forming the left and right locking regions.

According to another aspect, the first protrusion step may include a first upper protrusion step formed in the first upper receiving groove, and a first lower protrusion step may be formed in the first lower receiving groove.

According to another aspect, the second protrusion step may include a second upper protrusion step formed in the second upper receiving groove, and a second lower protrusion step formed in the second lower receiving groove.

The foregoing and/or other aspects are achieved by providing a microwave oven, including: a body defining a cooking compartment to cook foodstuff; a door coupled with the body;

and a change device attached to the door, the change device including a pair of sliders, one of the sliders being locked from moving in a first direction toward a first side when the door is opened from the first side.

The change device may include at least one lever locking at least one of the sliders from moving in the first direction.

The change device may include a pair of holders, one of the holders being engaged with one of the sliders in a first position when the door is opened, the other of the holders being disengaged from the other of the sliders in a second position when the door is opened.

The other of the sliders may move in a second direction away from the first side when the door is opened from the first side.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION OF EMBODIMENTS

Figure 1:
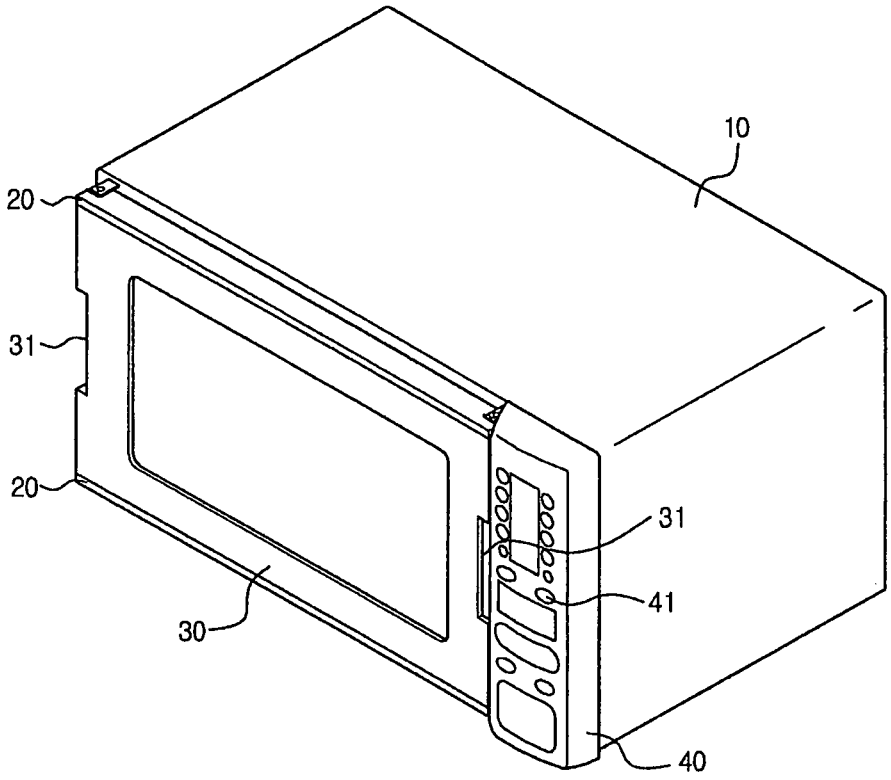
FIG. 1 is a view showing a microwave oven according to an embodiment.

Reference will now be made in detail to the embodiments of the disclosure, examples of which are illustrated in the accompanying drawings, wherein like reference numerals refer to the like elements throughout. The embodiments are described below to explain the disclosure by referring to the figures.

Hereinafter, a microwave oven according to the embodiment will be described with reference to accompanying drawings.

FIG. 1 is a view showing a microwave oven according to the embodiment.

As shown in FIG. 1, the microwave oven according to the embodiment includes a body 10 and a door 30 provided at a front surface of the body 10. The door 30 is provided at left and right side surfaces thereof with grips 31 to open/close the door 30. The door is provided at a back surface thereof with latching member 32 to cause the door 30 to be released from the microwave body. The door 30 is provided at a right side thereof with a control panel 40 having a plurality of buttons 41 to control various functions of the microwave oven, however the control panel 40 is not limited thereto and may be provided at any position on the body 10. The door 30 is provided at lower and upper portions thereof with change devices 20 used to open/close the left side or the right side of the door 30. According to the embodiment, the change devices 20 are provided at the lower and upper portions of the door 30 in symmetric to each other.

Figure 2:
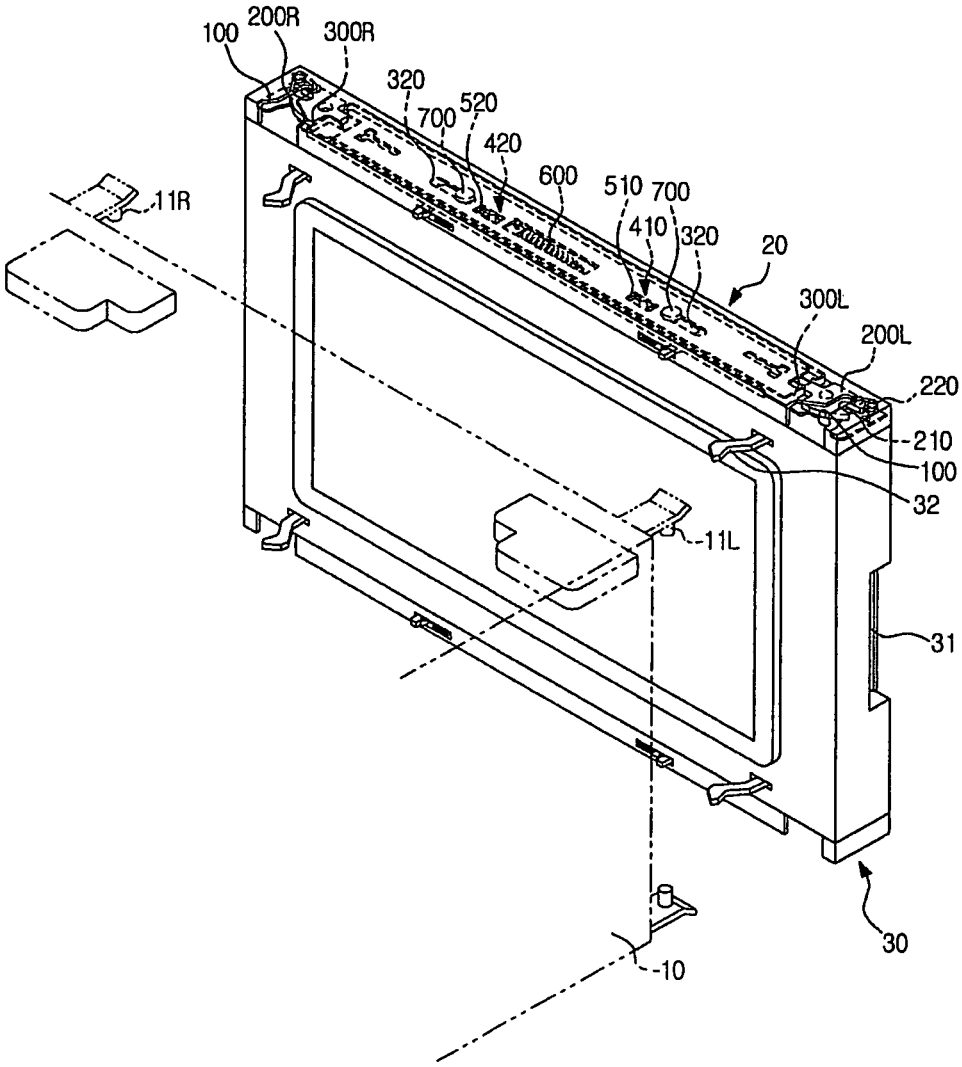
FIG. 2 is an exploded view showing the microwave oven according to the embodiment.
Figure 3:
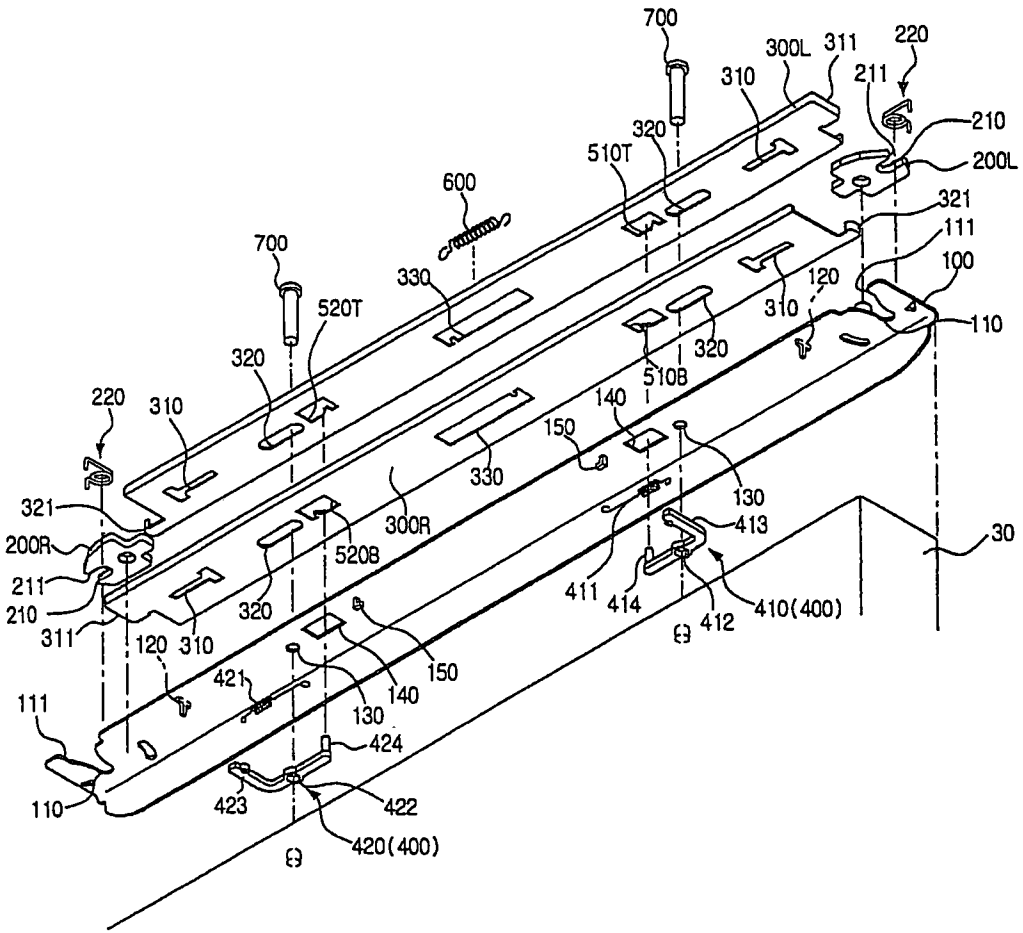
FIG. 3 is an exploded view showing a change device according to the embodiment.

FIG. 2 is an exploded view showing the microwave oven according to the embodiment, and FIG. 3 is an exploded view showing a change device according to the embodiment.

As shown in FIGS. 2 and 3, the change devices 20 according to the embodiment include a base member 100 coupled with the door 30, a pair of holders 200 rotatably mounted on the door 30, and a pair of sliders 300 interposed between the paired holders 200 such that the sliders 300 reciprocate.

The base member 100 is provided therein with a pair of insertion grooves 110 corresponding to a pair of shaft members 11 provided on the body 10. In an alternative, the insertion grooves 110 may be provided at the door 30 and the shaft members 11 may be provided at the door 30. The insertion grooves 110 have inlet parts 111 formed toward the body 10 such that the inlet parts 111 are configured to receive the shaft members 11.

The holders 200 cooperate with the shaft members 11 as the shaft members 11 are introduced into/withdrawn from the insertion grooves 110. The holders 200 are rotatably mounted on the door 30 by an incomplete screw (not shown). When the shaft members 11 are introduced into/withdrawn from the insertion grooves 110, the shaft members 11 rotate the holders 200 through grooves 210. One of the holders 200, which is coupled with a left shaft member 11L provided at the left side, is referred to as a first holder 200L, and the other of the holders 200, which is coupled with a right shaft member 11R provided at the right side, is referred to as a second holder 200R.

The sliders 300 are provided between the first and second holders 200L and 200R and control the rotation of the first and second holders 200L and 200R to restrict or release the first and second holders 200L and 200R.

The sliders 300 are installed between the first and second holders 200 in a longitudinal direction of the door 30. The sliders 300 include a first slider 300L and a second slider 300R vertically stacked on each other. The sliders 300 can perform reciprocation motion. The first slider 300L can perform reciprocating motion on the second slider 300R, and the second slider 300R can perform reciprocating motion between the first slider 300L and the door 30. Guide holes 310 provided in the first and second sliders 300 are coupled with guide protrusions 120 protruding from the base member 100 to guide the reciprocation motion of the first and second sliders 300L and 300R.

The first and second sliders 300 are provided at one end thereof with a side surface 311, and at the other end thereof with a rotation restriction part 321. The side surface 311 provided at the first slider 300L makes close contact with the first holder 200L, and the side surface 311 provided at the second slider 300R makes close contact with the second holder 200R. A tension spring 600 is provided such that the first and second sliders 300 make close contact with the first and second holders 200 as described above. One end of the tension spring 600 is coupled with the first slider 300L, and the other end of the tension spring 600 is coupled with the second slider 300R. Accordingly, the tension spring 600 having elasticity allows the first and second sliders 300L and 300R to move in directions opposite to each other. The sliders 300 each include a through hole 330 defined therein to receive the tension spring 600.

Since the first and second sliders 300 make close contact with the first and second holders 200 by the tension spring 600 as described above, the first and second sliders 300 linearly perform reciprocating motion in cooperation with the first and second holders 200 when the first and second holders 200 rotate. As the first and second sliders 300 linearly perform reciprocating motion as described above, the rotation of the first and second holders 200 may be restricted or allowed.

If the first holder 200L is arranged such that an inlet part 211 of the groove 210 faces the body 10, it will be referred to as "a first waiting position." When the first holder 200L is placed at the first waiting position, both the inlet part 211 of the groove 210 and the inlet part 111 of the insertion groove 110 face the body 10. Accordingly, the first shaft member 11L can be inserted into the groove 210 and the insertion groove 110. A torsion spring 220 is provided to maintain the first holder 200L at the first waiting position such that the inlet part 211 of the groove 210 faces the body 10.

The torsion spring 220 has one end fixed on a bottom fixture part (not shown) of the first holder 200L, and the other end fixed on a top fixture part (not shown) of the door 30. Accordingly, if the door 30 is opened, the torsion spring 220 fixes the position of the first holder 200L such that the inlet part 211 of the groove 210 faces the body 10.

If the second holder 200R is arranged such that the inlet part 211 of the groove 210 faces a side surface of the body 10, it will be referred to as "a second waiting position." When the second holder 200R is at the second waiting position, the inlet part 211 of the groove 210 face a side surface of the door 30, and the inlet part 111 of the insertion groove 110 faces the body 10. In this case, the torsion spring 220 fixes the position of the second holder 200R such that the inlet part 211 of the groove 210 faces the side surface of the door 30. As the first holder 200L rotates, the first holder 200L is alternately placed at the first waiting position and the second waiting position. In addition, as the second holder 200R rotates, the second holder 200R is alternately placed at the first waiting position and the second waiting position.

Through holes 320 of the first and second sliders 300 allow a pair of levers 400 to be coupled with the door 30 by a hinge pin 700. The levers 400 include a first lever 410 inserted into a predetermined space of the first slider 300L when the door 30 opens from the left side thereof, and a second lever 420 inserted into a predetermined space of the second slider 300R when the door 30 opens from the right side thereof. The first and second levers 410 and 420 are symmetrical to each other at both sides of an upper portion of the door 30.

The first lever 410 is interposed between the base member 100 and the left upper portion of the door 30 when viewed from the front surface of the door 30. A rotational center portion 412 of the first lever 410 is coupled with the door 30 by the hinge pin 700. The first lever 410 is provided at one end thereof with a bending part 413 making contact with one surface of the body 10 to receive rotary power as the door 30 is closed at one of the left and right sides. The first lever 410 is provided at the other end thereof with a locking part 414 which is inserted into a predetermined space of a first receiving groove 510 and then locked. The bending part 413 of the first lever 410 is coupled with a tension spring 411 to provide rotary power to the first lever 410 as the door 30 is opened at one of the left and right sides.

The second lever 420 is interposed between the base member 100 and the right side of the upper portion of the door 30. A rotational center portion 422 of the second lever 420 is coupled with the door 30 by the hinge pin 700 similarly to the first lever 410. The second lever 420 is provided at one end thereof with a bending part 423 making contact with one surface of the body 10 to receive rotary power as the door 30 is closed toward one of the left and right sides thereof. The second lever 420 is provided at the other end thereof with a locking part 424 which is inserted into a predetermined space of a second receiving groove 520 and then locked. The bending part 423 of the second lever 420 is coupled with a tension spring 421 to provide rotary power to the second lever 420 as the door 30 is opened from one of the left and right sides.

The sliders 300 include a first receiving groove 510 and a second receiving groove 520. The first receiving groove 510 is formed at a left side of the sliders 300 to receive the locking part 414 of the first lever 410. The second receiving groove 520 is formed at a right side of the sliders 300 to receive the locking part 424 of the second lever 420.

The base member 100 includes through holes 130 defined therein that correspond to the through holes 320 provided at the sliders 300, and through holes 140 defined therein allowing the locking parts 414 and 424 to be locked with the first and second receiving grooves 510 and 520. The base member 100 also includes fixing members 150 fixing the tension springs 411 and 421.

Figure 4A:
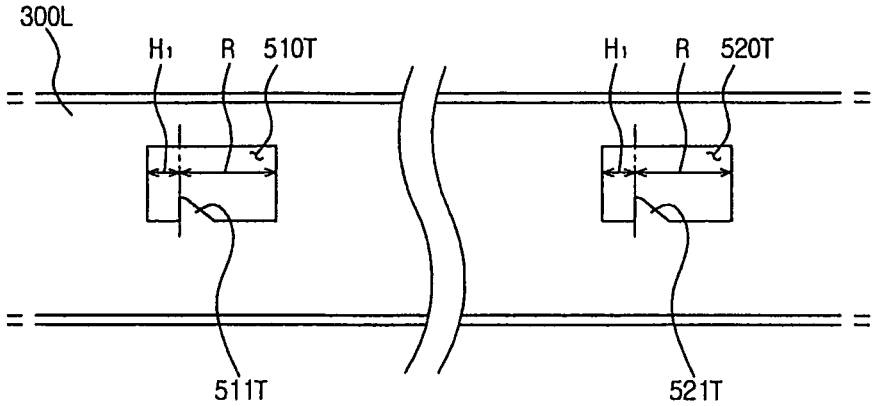
FIGS. 4A to 4C are views showing receiving grooves formed in sliders.
Figure 4B:
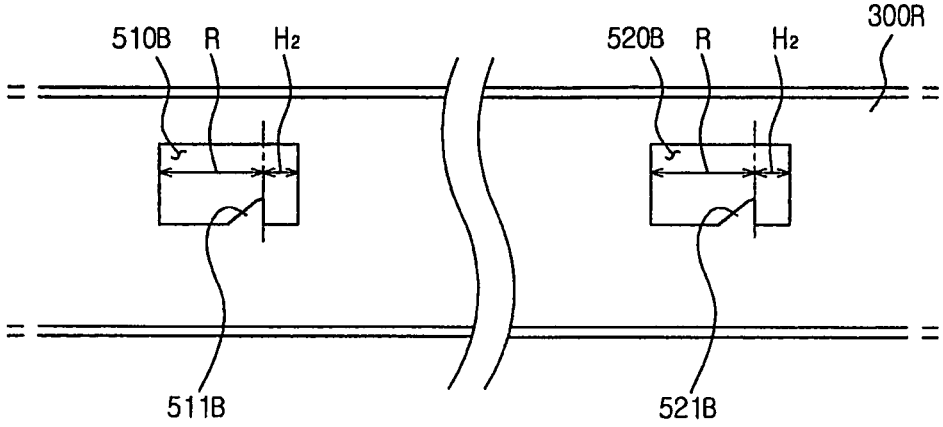
Figure 4C:
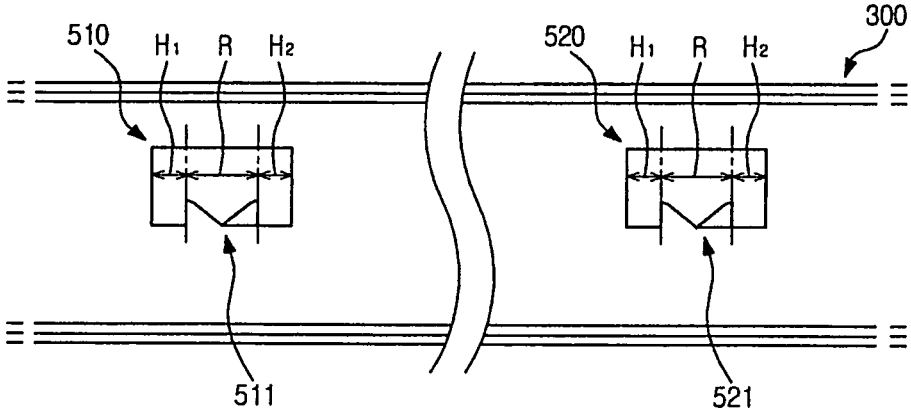

FIG. 4A is a view showing first and second upper receiving grooves 510T and 520T formed in the first slider 300L, and FIG. 4B is a view showing first and second lower receiving grooves 510B and 520B formed in the second slider 300R. FIG. 4C is a view showing the first and second receiving grooves 510 and 520 when the first and second sliders 300L and 300R are vertically stacked on each other.

As shown in FIGS. 3 to 4C, the first receiving groove 510 is formed by vertically stacking the first upper and lower receiving grooves 510T and 510B, in which the first upper receiving groove 510T is formed in the first slider 300L positioned above the second slider 300R, and the first lower receiving groove 510B is formed in the second slider 300R positioned below the first slider 300L.

The first upper and lower receiving grooves 510T and 510B include first protrusion steps 511 restricting the linear movement of the first and second sliders 300 as the door 30 is open from one of left and right sides thereof. The first protrusion steps 511 may be provided by overlapping triangles having a straight part and an inclined part with respect to each other. The first protrusion steps 511 form a release region R in which the locking of the first lever 410 is released by the inclined part in the first receiving groove 510. In addition, the first protrusion steps 511 form left and right locking regions H1 and H2 in which the first lever 410 is locked by the straight part in the first receiving groove 510. The first protrusion steps 511 include a first upper protrusion step 511T formed in the first upper receiving groove 510T, and a first lower protrusion step 511B formed in the first lower receiving groove 510B.

The first upper receiving groove 510T is divided into the release resion R, in which the locking of the first lever 410 is released, and the left locking region H1, in which the first lever 410 is locked as the door 30 is opened from the left side, based on the first upper protrusion 511T.

The second lower receiving groove 510B is divided into the release region R, in which the locking of the first lever 410 is released, and the right locking region H2, in which the first lever 140 is locked as the door 30 is opened from the right side, based on the first lower protrusion 511B.

Accordingly, when the door 30 is opened from one of the left and right sides, the first lever 410 moves to the left locking region H1 from the release region R, or to the right locking region H2 from the release region R, and details thereof will be described later.

The second receiving groove 520 is formed by stacking the second upper receiving groove 520T, which is formed in the first slider 300L provided at an upper portion, and the second lower receiving groove 520B, which is formed in the second slider 300R provided at a lower portion. The second upper and lower receiving grooves 520T and 520B include second protrusion steps 521 to restrict the linear movement of the first and second slider 300 as the door 30 is opened from one of the left and right sides. The second protrusion steps 521 may be provided by overlapping triangles having a straight part and an inclined part with respect to each other. The second protrusion steps 521 form the release region R in which the locking of the second lever 420 is released by the inclined part in the second receiving groove 520. In addition, the second protrusion steps 521 form the left and right locking regions H1 and H2 in which the second lever 420 is locked through the straight part. The second protrusion steps 521 include a second upper protrusion step 521T formed in the second upper receiving groove 520T and a second lower protrusion step 521B formed in the second lower receiving groove 520B.

The second upper receiving groove 520T is divided into the release region R, in which the locking of the second lever 420 is released, and the left locking region H1, in which the second lever 420 is locked as the door 30 is opened from the left side, based on the second upper protrusion step 521T.

The second lower receiving groove 520B is divided into the release region R, in which the locking of the second lever 420 is released, and the right locking region H2, in which the second lever 420 is locked as the door 30 is opened from the right side, based on the second lower protrusion step 521B.

Accordingly, when the door 30 is opened from one of the left and right sides, the second lever 420 moves from the release region R to the left locking region H1, or from the release region R to the right locking region H2. Details thereof will be described in detail later.

Hereinafter, the operational procedure of the change device 20 according to the embodiment will be described.

Figure 5:
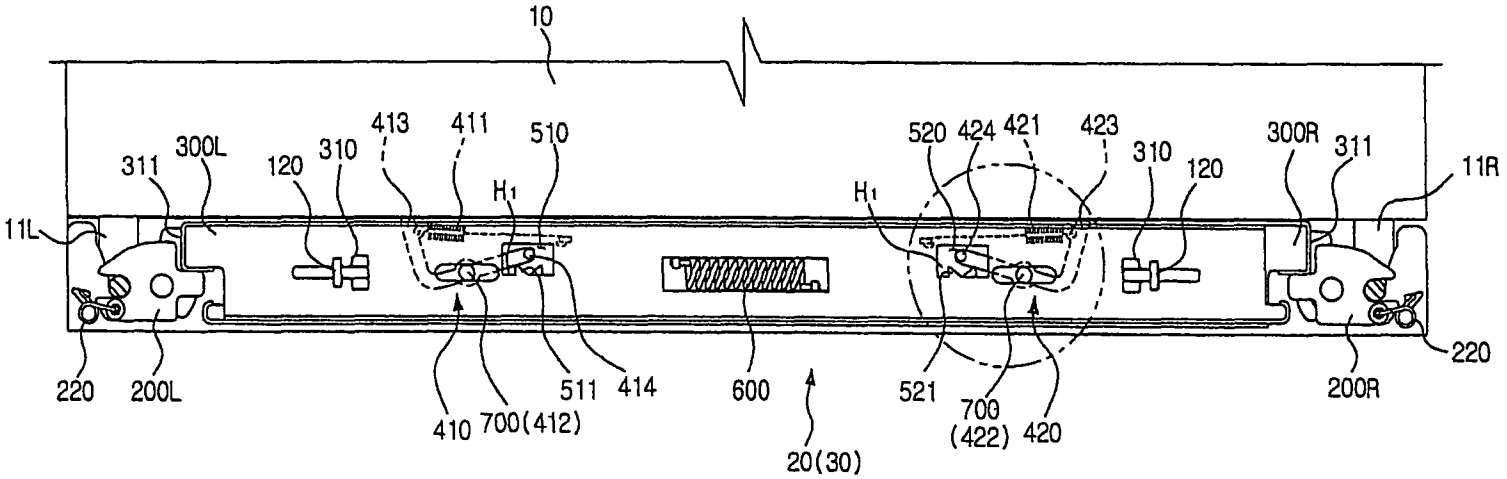
FIG. 5 is a view showing the change device when the door is closed in the microwave oven according to the embodiment.
Figure 6:
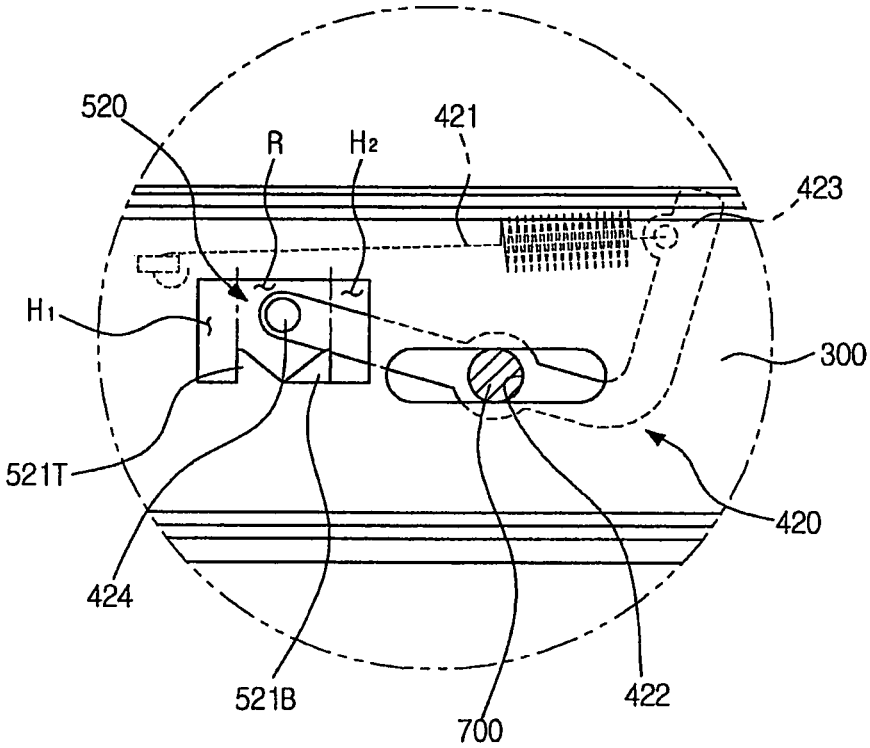
FIG. 6 is an enlarged view showing a portion of FIG. 5.

FIG. 5 is a view showing the change device 20 when the door 30 is closed in the microwave oven according to the embodiment, and FIG. 6 is an enlarged view showing a portion of FIG. 5.

As shown in FIGS. 5 and 6, when the door 30 is closed in the microwave oven according to the embodiment, the first and second holders 200L and 200R are maintained at the second waiting position.

In the case of the first lever 410, the locking part 414 is placed in the release region R of the first receiving groove 510 by the bending part 413. In the case of the second lever 420, the locking part 424 is placed in the release region R of the second receiving groove 520 by the bending part 423. In addition, by the tension spring 600, the side surface 311 of the first slider 300L makes close contact with the first holder 200L, and the side surface 311 of the second slider 300R makes close contact with the second holder 200R. Accordingly, the microwave oven stably maintains the closed state of the door 30.

Figure 7:
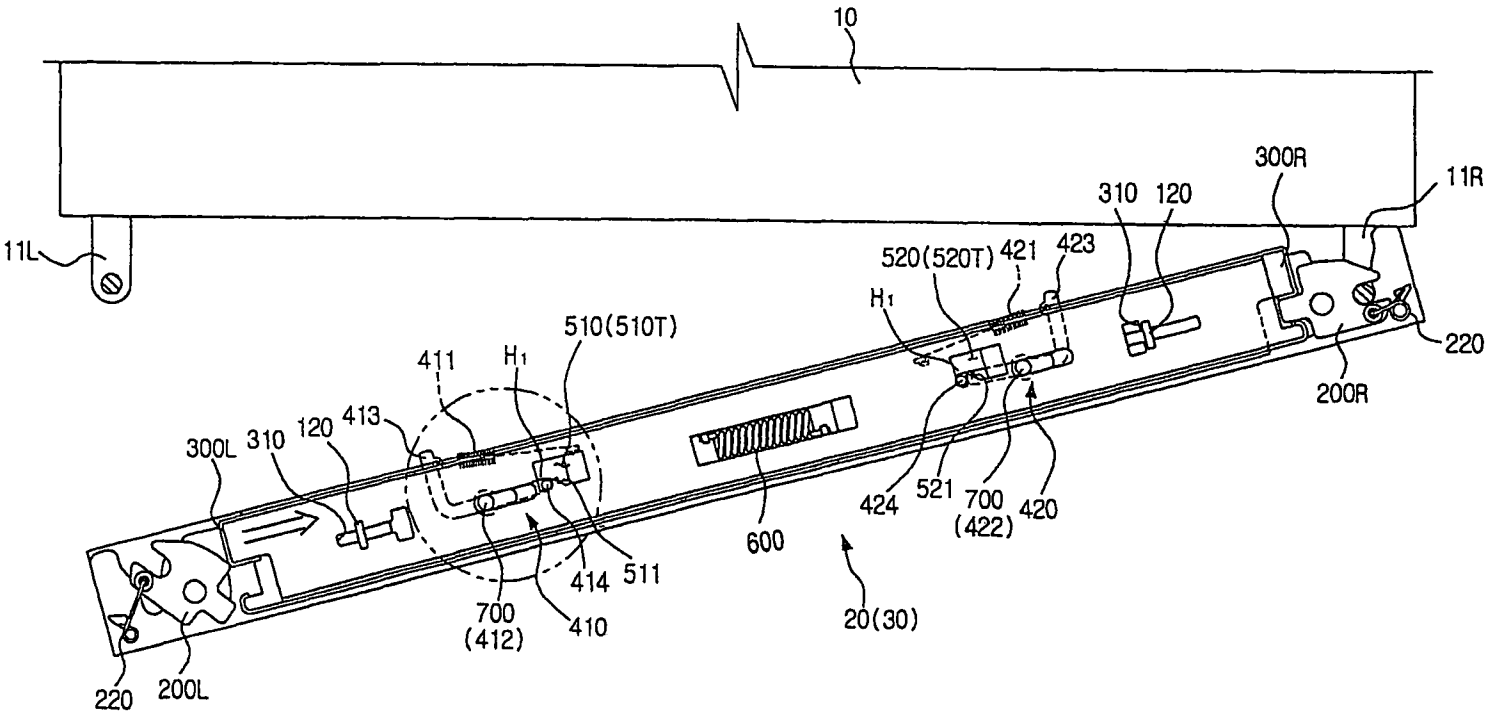
FIG. 7 is a view showing the change device when the left side of the door is opened in the microwave oven according to the embodiment.
Figure 8:
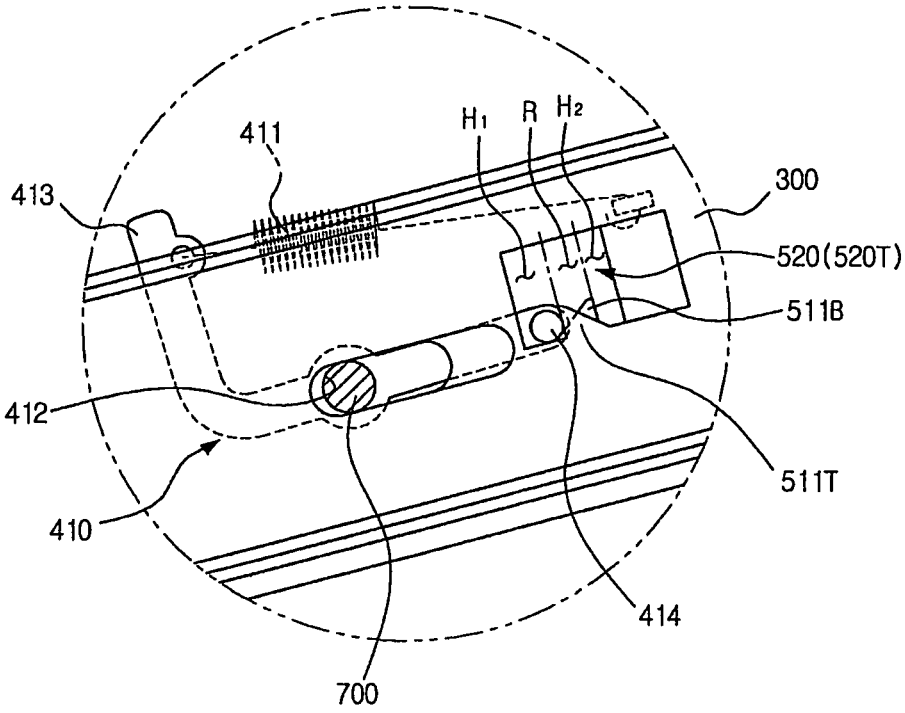
FIG. 8 is an enlarged view showing a portion of FIG. 7.

FIG. 7 is a view showing the change device 20 when the left side of the door 30 is opened in the microwave oven according to the embodiment, and FIG. 8 is an enlarged view showing a portion of FIG. 7.

As shown in FIGS. 7 and 8, after the first holder 200L has rotated in cooperation with the first shaft member 11L in the door 30 according to the embodiment, the first holder 200L is maintained by the torsion spring 220 at the first waiting position, and the second holder 200R is maintained by the torsion spring 220 in the second waiting position. While the first holder 200L moves from the second waiting position to the first waiting position while rotating, the first holder 200L allows the first slider 300L to move rightward. As the first slider 300L moves rightward, the left locking region H1 of the first upper receiving groove 510T and the second upper receiving groove 520T moves rightward.

In this case, the locking part 414 of the first lever 410 rotates about the rotational center portion 412 by elasticity of the tension spring 411. The locking part 414 of the first lever 410 is locked in the left locking region H1 of the first upper receiving groove 510T moving rightward. In addition, the locking part 414 of the first lever 410 makes close contact with the first lower protrusion step 511B in a state in which the locking part 414 is locked in the left locking region H1. In other words, as the door 30 is opened from the left side, the first upper protrusion step 511T moves such that the inclined surface of the first upper protrusion step 511T crosses the inclined surface of the first lower protrusion step 511B, and the locking part 414 of the first lever 410 makes close contact with the first upper protrusion step 511T and the first lower protrusion step 511B in a state in which the first lever 410 is locked in the left locking region H1.

Simultaneously, the locking part 424 of the second lever 420 rotates about the rotational center portion 422 by elasticity of the tension spring 421. The locking part 424 of the second lever 420 is locked in the left locking region H1 of the second upper receiving groove 520T moving rightward. The locking part 424 of the second lever 420 makes close contact with the second upper and lower protrusion steps 521T and 521B in a state in which the locking part 424 is locked in the left locking region H1.

In other words, even if the first holder 200L moves to the second waiting position in a state in which the left side of the door 30 is opened, the locking part 414 of the first lever 410 is locked in the left locking region H1, and the locking part 424 of the second lever 420 is locked in the left locking region H1. Accordingly, even if a user tries to open the right side of the door 30, the second slider 300R does not move leftward, so that the movement of the second holder 200R to the first waiting position is restricted. Accordingly, the door 30 that can be opened from the left side or the right side thereof can be prevented from being simultaneously opened from the left and right sides.

Figure 9:
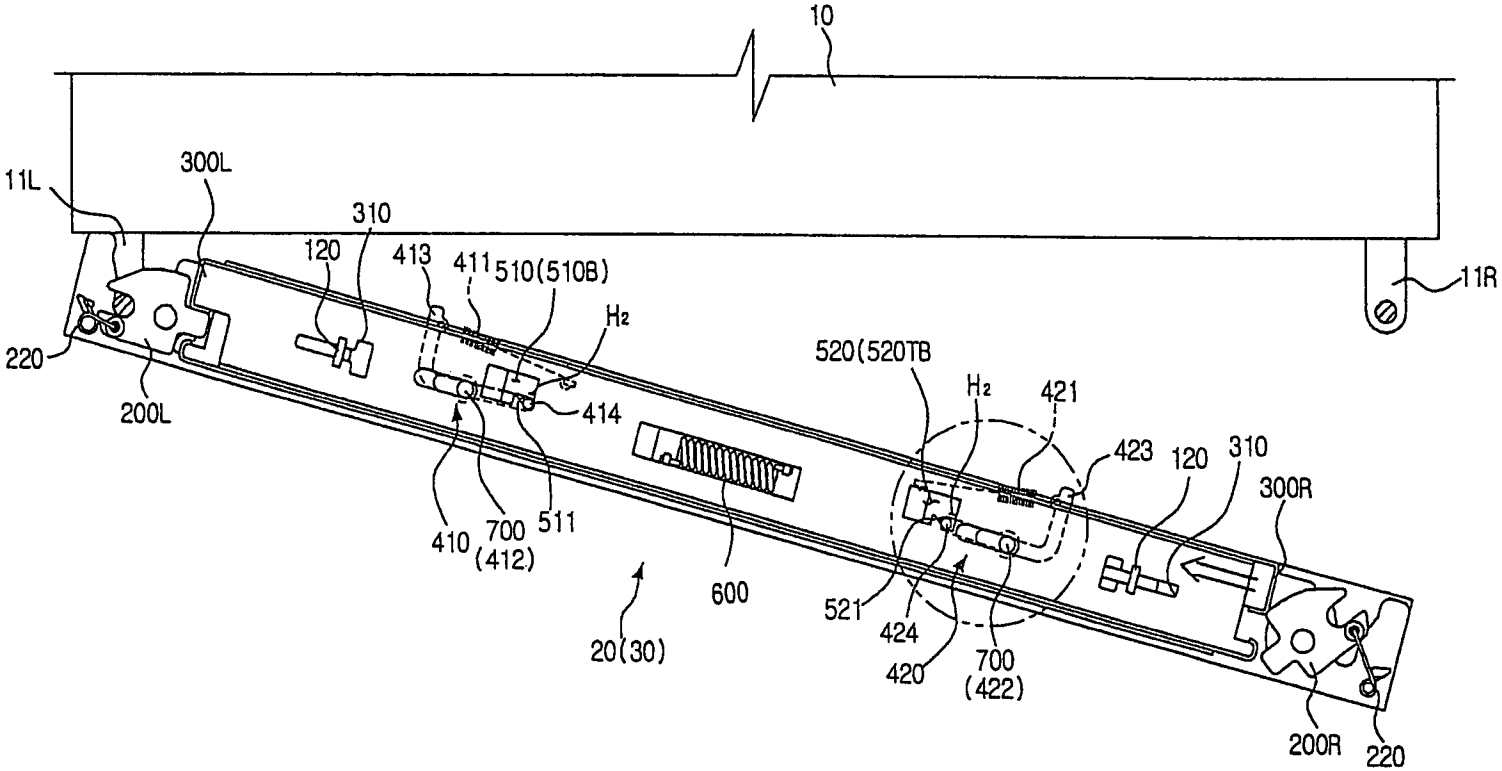
FIG. 9 is a view showing the change device when the right side of the door is opened in the microwave oven according to the embodiment.
Figure 10:
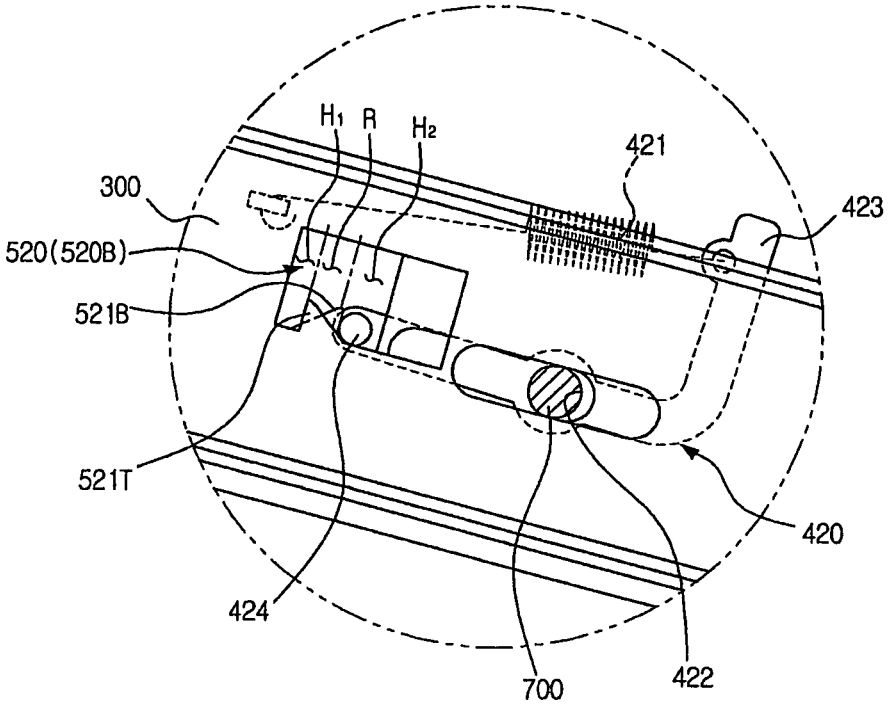
FIG. 10 is an enlarged view showing a portion of FIG. 9.

FIG. 9 is a view showing the change device 20 when the right side of the door 30 is open in the microwave oven according to the embodiment, and FIG. 10 is an enlarged view showing a portion of FIG. 9.

As shown in FIGS. 9 and 10, the first holder 200L rotates in cooperation with the first shaft member 11L in the door 30 of the microwave oven according to the embodiment, so that the first holder 200L is maintained at the second waiting position. After the second holder 200R has rotated in cooperation with the second shaft member 11R, the second holder 200R is maintained by the torsion spring 220 at the first waiting position. While the second holder 220R is moving from the second waiting position to the first waiting position, the second holder 220R allows the second slider 300R to move leftward. As the second holder 220R moves leftward, the right locking region H2 of the first lower receiving groove 510B and the second lower receiving groove 520B moves leftward.

The locking part 424 of the second lever 420 rotates about the rotational center portion 422 by elasticity of the tension spring 421. The locking part 424 of the second lever 420 is locked and fixed in the right locking region H2 of the second lower receiving groove 520B moving leftward. Then, the locking part 424 of the second lever 420 makes close contact with the second upper protrusion step 521T of the first slider 300L in a state in which the locking part 424 is locked in the right locking region H2. In other words, as the right side of the door 30 is opened, the second lower protrusion step 521B moves such that the inclined surface of the second lower protrusion step 521B crosses the inclined surface of the second upper protrusion step 521T, and the locking part 424 of the second lever 420 makes close contact with the second lower protrusion step 521B and the second upper protrusion step 521T in a state in which the locking part 424 is locked in the right locking region H2.

Simultaneously, the locking part 414 of the first lever 410 rotates about the rotational center portion 412 by the elasticity of the tension spring 411. The locking part 414 of the first lever 410 is locked in the right locking region H2 of the first lower receiving groove 510B moving leftward. The locking part 414 of the first lever 410 makes close contact with the first lower protrusion step 511B and the first upper protrusion step 511T in a state in which the locking part 414 is locked in the right locking region H2.

Accordingly, even if the second holder 200R moves to the second waiting position in a state in which the right side of the door 30 opens, the locking part 424 of the second lever 420 is locked with the second upper and lower protrusion steps 521T and 521B, and the locking part 414 of the first lever 410 is locked with the first upper and lower protrusion steps 511T and 511B. Accordingly, the first slider 300L is prevented from moving rightward. Therefore, even if the user tries to open the left side of the door 30, the first slider 300L is prevented from moving rightward, so that the first holder 200L is prevented from moving to the first waiting position. Thus, the door 30 that can be opened from the left side or the right side thereof can be prevented from being simultaneously opened from the left and right sides.

Although few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A microwave oven, comprising:

a body defining a cooking compartment to cook foodstuff;

a door coupled with the body; and a change device at the door, allowing the door to be opened from two sides thereof, the change device including a first and second holders rotating as the door is opened from either side thereof, a first and second sliders linearly moving in cooperation with the holders, and at least one lever restricting the linear movement of the sliders when the door is opened from one side thereof and preventing the door from being opened from the other side, wherein the first slider is disposed on the second slider to allow the first and second slider to perform a reciprocating motion on each other.

2. The microwave oven of claim 1, wherein the lever includes a locking part which is locked in a predetermined region of the sliders to fix the sliders.

3. The microwave oven of claim 2, wherein the sliders each include a receiving groove receiving the locking part.

4. The microwave oven of claim 2, wherein the lever includes a tension spring allowing the locking part to be inserted in and maintained within the sliders.

5. The microwave oven of claim 3, wherein the receiving groove has a locking region in which the locking part is locked by a pair of protrusion steps defined within the sliders.

6. The microwave oven of claim 5, wherein the locking region includes a left locking region, in which the locking part is locked when the door is opened from a left side, and a right locking region in which the locking part is locked when the door is opened from a right side.

7. The microwave oven of claim 6, wherein the locking part makes close contact with the protrusion steps when the locking part is locked in the left locking region or the right locking region.

8. A microwave oven, comprising:

a body defining a cooking compartment to cook foodstuff;

a door coupled with the body;

a first and second shaft members provided in one of the body and the door;

a first and second insertion grooves provided in the other of the body and the door;

a first and second holders rotating in cooperation with the first and second shaft members as the first and second shaft members are introduced into/withdrawn from the first and second insertion grooves; and at least one lever fixing a first slider or a second slider when one of the first and second holders is separated from one of the first and second shaft members, wherein the first slider is disposed on the second slider.

9. The microwave oven of claim 8, wherein the at least one lever includes a first lever fixing the first and second sliders at a left side of the door and a second lever fixing the first and second sliders at a right side of the door.

10. The microwave oven of claim 9, wherein the first and second sliders each have a first receiving groove receiving the first lever and a second receiving groove receiving the second lever.

11. The microwave oven of claim 10, wherein the first and second levers are coupled with a tension spring such that the first and second levers are inserted into and maintained within the first and second receiving grooves.

12. The microwave oven of claim 10, wherein the first receiving groove includes a first upper receiving groove formed in the first slider and a first lower receiving groove formed in the second slider, and the second receiving groove includes a second upper receiving groove formed in the first slider, and a second lower receiving groove formed in the second slider.

13. The microwave oven of claim 12, wherein the first and second upper receiving grooves have a left locking region in which the first and second levers are locked when the first holder is separated from the first shaft member, and the first and second lower receiving grooves have a right locking region in which the first and second levers are locked when the second holder is separated from the second shaft member.

14. The microwave oven of claim 13, wherein the first and second receiving grooves are provided therein with first and second protrusion steps forming the left and right locking regions.

15. The microwave oven of claim 14, wherein the first protrusion step includes a first upper protrusion step formed in the first upper receiving groove, and a first lower protrusion step formed in the first lower receiving groove.

16. The microwave of claim 14, wherein the second protrusion step includes a second upper protrusion step formed in the second upper receiving groove, and a second lower protrusion step formed in the second lower receiving groove.

17. A microwave oven, comprising:

a body defining a cooking compartment to cook foodstuff;

a door coupled with the body; and a change device attached to the door, the change device including a first and second sliders, one of the sliders being locked from moving in a first direction toward a first side when the door is opened from the first side, wherein the first slider is disposed on the second slider to allow the first and second slider to perform a reciprocating motion on to each other.

18. The microwave oven of claim 17, wherein the change device includes at least one lever locking at least one of the sliders from moving in the first direction.

19. The microwave oven of claim 17, wherein the change device includes a pair of holders, one of the holders being engaged with one of the sliders in a first position when the door is opened, the other of the holders being disengaged from the other of the sliders in a second position when the door is opened.

20. The microwave oven of claim 17, wherein the other of the sliders moves in a second direction away from the first side when the door is opened from the first side.

21. A change device used in conjunction with a door of a microwave oven, comprising:

a first and second sliders; and at least one lever locking at least one of the sliders from moving in a first direction toward a first side when the door is opened from the first side, wherein the first slider is disposed on the second slider; and wherein the first slider can perform reciprocating motion on the second slider and the second slider can perform reciprocating motion between the first slider and the door.

* * * * *

UNITED STATES PATENT AND TRADEMARK OFFICE

CERTIFICATE OF CORRECTION

PATENT NO. : 8,729,439 B2
APPLICATION NO. : 12/461958
DATED : May 20, 2014
INVENTOR(S) : Gong Soo Kim It is certified that error appears in the above-identified patent and that said Letters Patent is hereby corrected as shown below:

In the Claims

Column 10, Line 54, In Claim 16, after “microwave” insert -- oven --.

Signed and Sealed this
Eighteenth Day of November, 2014

Michelle K. Lee

Michelle K. Lee
*Deputy Director of the United States Patent and Trademark Office*